US011830411B2

(12) United States Patent
Kim

(10) Patent No.: US 11,830,411 B2
(45) Date of Patent: Nov. 28, 2023

(54) DISPLAY DRIVING CIRCUIT

(71) Applicant: LX Semicon Co., Ltd., Daejeon (KR)

(72) Inventor: Jin Woo Kim, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/952,936

(22) Filed: Sep. 26, 2022

(65) Prior Publication Data

US 2023/0123909 A1 Apr. 20, 2023

(30) Foreign Application Priority Data

Oct. 14, 2021 (KR) ..... 10-2021-0136451

(51) Int. Cl.
*G09G 3/20* (2006.01)

(52) U.S. Cl.
CPC ... *G09G 3/2092* (2013.01); *G09G 2300/0814* (2013.01); *G09G 2300/0828* (2013.01); *G09G 2310/0291* (2013.01); *G09G 2330/021* (2013.01)

(58) Field of Classification Search
CPC ..... G09G 3/3233; G09G 2330/021
See application file for complete search history.

(56) References Cited

U.S. PATENT DOCUMENTS

2004/0263450 A1* 12/2004 Lee ..... G09G 3/006 345/87
2015/0243204 A1* 8/2015 Park ..... G09G 3/3688 345/212
2015/0325200 A1* 11/2015 Rho ..... G09G 3/3688 345/212
2016/0098959 A1* 4/2016 Moon ..... G09G 3/2092 345/205
2017/0004792 A1* 1/2017 Deng ..... G09G 3/3677

* cited by examiner

*Primary Examiner* — Nan-Ying Yang
(74) *Attorney, Agent, or Firm* — POLSINELLI PC

(57) ABSTRACT

A display driving circuit which is improved to actively control current consumption depending on a change in a pattern displayed on a screen. The display driving circuit includes a current controller configured to provide a current control signal corresponding to a data change amount between first display data of a current frame and second display data of a previous frame; and an output buffer configured to sequentially output source signals corresponding to the second display data and the first display data.

16 Claims, 5 Drawing Sheets

| LA2 | | LA1 | | LC |
|---|---|---|---|---|
| <0,0> | | <0,0> | | L |
| <0,0> | | <0,1> | | L |
| <0,0> | | <1,0> | | H |
| <0,0> | | <1,1> | | H |
| <0,1> | | <0,0> | | L |
| <0,1> | | <0,1> | | L |
| <0,1> | | <1,0> | | L |
| <0,1> | Calculation | <1,1> | ⟹ | H |
| <1,0> | | <0,0> | | H |
| <1,0> | | <0,1> | | L |
| <1,0> | | <1,0> | | L |
| <1,0> | | <1,1> | | L |
| <1,1> | | <0,0> | | H |
| <1,1> | | <0,1> | | H |
| <1,1> | | <1,0> | | L |
| <1,1> | | <1,1> | | L |

| LA2 | | LA1 | | LC1 | LC2 | LC3 |
|---|---|---|---|---|---|---|
| <0,0> | | <0,0> | | L | L | L |
| <0,0> | | <0,1> | | H | L | L |
| <0,0> | | <1,0> | | H | H | L |
| <0,0> | | <1,1> | | H | H | H |
| <0,1> | | <0,0> | | H | L | L |
| <0,1> | | <0,1> | | L | L | L |
| <0,1> | | <1,0> | | H | L | L |
| <0,1> | | <1,1> | | H | H | L |
| <1,0> | Calculation | <0,0> | ⟹ | H | H | L |
| <1,0> | | <0,1> | | H | L | L |
| <1,0> | | <1,0> | | L | L | L |
| <1,0> | | <1,1> | | H | L | L |
| <1,1> | | <0,0> | | H | H | H |
| <1,1> | | <0,1> | | H | H | L |
| <1,1> | | <1,0> | | H | L | L |
| <1,1> | | <1,1> | | L | L | L |

DISPLAY DRIVING CIRCUIT

BACKGROUND

1. Technical Field

Various embodiments generally relate to a display driving circuit, and more particularly, to a display driving circuit which is improved to actively control current consumption depending on a change in a pattern displayed on a screen.

2. Related Art

A display device may be configured by adopting a display driving circuit which is constituted by a semiconductor chip.

The display driving circuit is configured to receive display data and provide a source signal corresponding to the display data to a display panel for each channel. To this end, the display driving circuit may be configured to include a latch, a digital-to-analog converter and an output buffer for each channel.

Among them, the output buffer is configured to output a source signal corresponding to a voltage outputted from the digital-to-analog converter, and is to drive a panel load of the display panel. The panel load means that the display panel acts as a load.

The output buffer is configured to use bias currents of various uses. For example, the bias currents may be divided into a bias current for receiving an input voltage, a bias current for converting the input voltage into an internal voltage and a bias current for driving an output transistor.

Among them, the bias current for driving the output transistor is to output a source signal corresponding to the internal voltage.

The amount of current consumption of the output buffer corresponds to about 50% of the total amount of current consumption of the display driving circuit, and the amount of current consumption by the bias current for driving the output transistor corresponds to about 50% of the total amount of current consumption of the output buffer.

The display driving circuit needs to be configured to reduce the amount of current consumption, and to this end, the structure of the output buffer also needs to be improved to reduce the amount of current consumption.

SUMMARY

Various embodiments are directed to a display driving circuit capable of reducing the amount of current consumption.

In particular, various embodiments are directed to a display driving circuit capable of reducing the total amount of current consumption by reducing an amount of current required to output a source signal.

In an embodiment, a display driving circuit may include: a current controller configured to provide a current control signal corresponding to a data change amount between first display data of a current frame and second display data of a previous frame; and an output buffer configured to sequentially output source signals corresponding to the second display data and the first display data, wherein an amount of a bias current of the output buffer is controlled to depend on the data change amount in response to the current control signal.

In an embodiment, a display driving circuit may include: a first latch configured to store first display data of a current frame; a second latch configured to store second display data of a previous frame transferred from the first latch; a current controller configured to provide a current control signal corresponding to a data change amount between the first display data and the second display data; and an output buffer configured to sequentially output source signals corresponding to the second display data and the first display data outputted by the unit of frame from the second latch, wherein an amount of a bias current of the output buffer is controlled to depend on the data change amount in response to the current control signal.

The present disclosure may control an amount of bias current required to output a source signal, depending on a data change amount of display data in units of frames.

That is to say, an output buffer may output a source signal using a bias current of a low amount of current when a data change amount of display data is small, and may output a source signal using a bias current of a high amount of current when a data change amount of display data is large.

As described above, the present disclosure may control the amount of current consumption by the bias current of the output buffer, depending on a data change amount of display data, and as a result, an advantage may be provided in that it is possible to reduce the total amount of current consumption of a display driving circuit.

DETAILED DESCRIPTION

Figure 1:
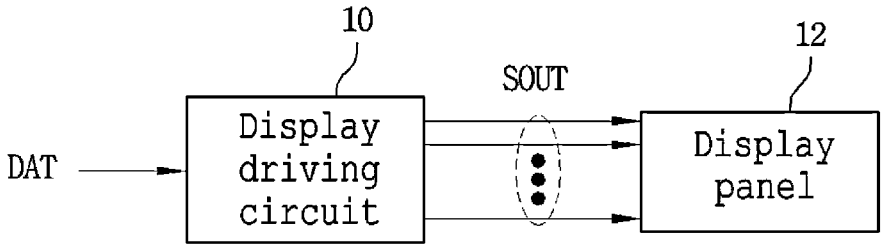
FIG. 1 is a diagram illustrating a display device.

As shown in FIG. 1, a display device may include a display driving circuit 10 and a display panel 12.

The display driving circuit 10 is configured to receive display data DAT in units of frames and provide source signals SOUT corresponding to the display data DAT to the display panel 12 through a plurality of channels.

The display panel 12 may include pixels (not shown) which are configured as an OLED or an LCD, may receive the source signals SOUT, and may form a screen as the pixels are driven by the source signals SOUT.

It may be understood that the display data DAT corresponding to one screen formed on the display panel 12 corresponds to one frame. In other words, the display panel 12 may continuously display screens by the display data DAT in units of frames, which are received periodically.

The display driving circuit 10 may output the source signal SOUT by processing the display data DAT for each channel. To this end, the display driving circuit 10 of the present disclosure may be implemented as shown in FIG. 2.

Figure 2:
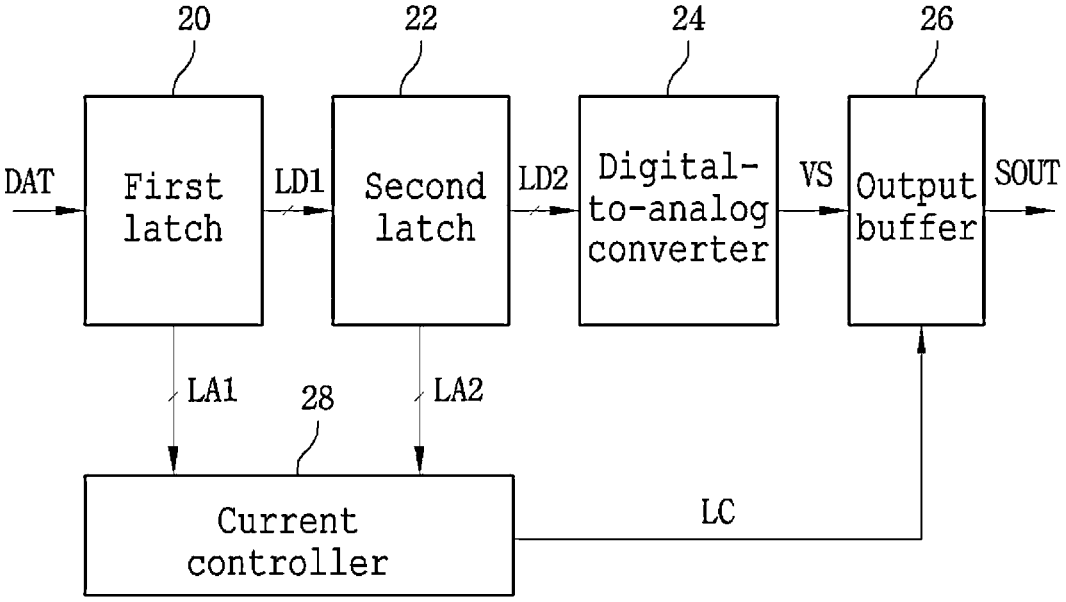
FIG. 2 is a block diagram illustrating an embodiment of a display driving circuit in accordance with the present disclosure.

The embodiment of FIG. 2 may include a first latch 20, a second latch 22, a digital-to-analog converter 24, an output buffer 26 and a current controller 28. It may be understood that the first latch 20, the second latch 22, the digital-to-analog converter 24, the output buffer 26 and the current controller 28 implemented in FIG. 2 are to process the display data DAT corresponding to one channel.

The first latch 20 includes latch elements (not shown) for storing the display data DAT for one channel. The latch elements sequentially shift the display data DAT which is inputted in series, and as a result, the first latch 20 may store the display data DAT for one channel.

Display data stored in the first latch 20 may be denoted by LD1, and the first latch 20 may output the stored display data LD1 in parallel at a preset output enable time point. The first latch 20 may provide preset first upper bits LA1 to the current controller 28.

After outputting the stored display data LD1 of a previous frame to the second latch 22, the first latch 20 may store display data DAT of a subsequent current frame for the corresponding channel.

The second latch 22 includes latch elements (not shown) for receiving and storing the display data LD1 for one channel, which is transferred in parallel from the first latch 20. The latch elements receive the display data LD1 which is transferred in parallel, and as a result, the second latch 22 may store the display data LD1 for one channel.

Display data stored in the second latch 22 may be denoted by LD2, and the second latch 22 may output the stored display data LD2 in parallel at a preset output enable time point. The second latch 22 may provide preset second upper bits LA2 to the current controller 28.

As described above, the first latch 20 is to convert the serial display data DAT into the parallel display data LD1, and the second latch 22 is to transfer the display data LD2, obtained by storing the parallel display data LD1, in parallel to the digital-to-analog converter 24.

The display data DAT is provided by the unit of a frame, and the first latch 20 and the second latch 22 are configured to store and output display data of another frame corresponding to the same channel. Making description on the basis of an input to the first latch 20, it may be understood that the first latch 20 stores the display data LD1 of a current frame and the second latch 22 stores the display data LD2 of a previous frame.

Hereinafter, the display data LD1 of the current frame is referred to as first display data LD1, and the display data LD2 of the previous frame is referred to as second display data LD2. Therefore, it may be understood that the first latch 20 stores and outputs the first display data LD1 of the current frame and the second latch 22 stores and outputs the second display data LD2 of the previous frame transferred from the first latch 20.

The digital-to-analog converter 24 is configured to receive the second display data LD2 outputted from the second latch 22, select a gray voltage corresponding to the value of the second display data LD2 and output the selected gray voltage as an input voltage VS of the output buffer 26.

Namely, it may be understood that the digital-to-analog converter 24 has a function of converting the digital second display data LD2 into the analog input voltage VS. A gamma voltage provider (not shown) may be configured separately from the digital-to-analog converter 24, and gray voltages for respective grays may be provided to the digital-to-analog converter 24 by the gamma voltage provider.

The current controller 28 is configured to receive the first upper bits LA1 of the first latch 20 and the second upper bits LA2 of the second latch 22 and provide a current control signal LC corresponding to a data change amount between the first display data LD1 and the second display data LD2, by using the first upper bits LA1 and the second upper bits LA2.

The output buffer 26 is configured to sequentially output the source signal SOUT corresponding to the second display data LD2 outputted from the second latch 22 by the unit of frame and the first display data LD1. To this end, the output buffer 26 may receive the analog input voltage VS converted from the second display data LD2 outputted from the second latch 22 by the unit of frame and the first display data LD1, and may output the source signal SOUT corresponding to the input voltage VS by using a bias current.

Although not shown in detail, the output buffer 26 requires various bias currents such as a bias current for receiving the input voltage VS, a bias current for converting the input voltage VS into an internal voltage and a bias current for driving an output transistor to output a source signal SOUT. Among these bias currents, the bias current for receiving the input voltage VS or the bias current for converting the input voltage VS into an internal voltage will be described later as a bias current IBI, and the bias current for driving an output transistor to output a source signal SOUT will be described later as a bias current IBO (see FIGS. 6 and 9).

In the embodiment of the present disclosure, an amount of current of the bias current of the output buffer 26 for the output of the source signal SOUT may be controlled in response to the current control signal LC of the current controller 28 to depend on a data change amount between the first display data LD1 and the second display data LD2. The embodiment of the present disclosure is configured to control an amount of current of the bias current IBO for driving an output transistor that accounts for about 50% of the total amount of current consumption of the output buffer 26 among the bias currents of the output buffer 26.

In order to control an amount of current of the bias current IBO of the output buffer 26 as described above, the current controller 28 is configured to provide the current control signal LC to the output buffer 26. To this end, as described above, the current controller 28 may be configured to receive the first upper bits LA1 from the first latch 20 and the second upper bits LA2 from the second latch 22.

The first upper bits LA1 correspond to upper bits of a preset number of bits among bits constituting the first display data LD1 stored in the first latch 20, and for example, may include the most significant bit and the second most significant bit of the first display data LD1. The second upper bits LA2 correspond to upper bits of a preset number of bits among bits constituting the second display data LD2 stored in the second latch 22, and for example, may include the most significant bit and the second most significant bit of the second display data LD2.

When display data DAT is constituted by eight bits, the display data DAT may have a bit value expressed as "11000000" for example, where the most significant bit is a bit in which the value of a first "1" is positioned and the second most significant bit is a bit in which the value of a second "1" is positioned. The most significant bit is a bit which indicates a most significant value, and the second most significant bit is a bit which indicates a second most significant value.

The current controller 28 may compare the first upper bits LA1 and the second upper bits LA2 described above, and may provide the current control signal LC as a comparison result. In more detail, the current controller 28 may be configured to provide the current control signal LC corresponding to a difference between the values of the first upper bits LA1 and the second upper bits LA2.

The current controller 28 described above may be configured as shown in FIG. 3.

Figure 3:
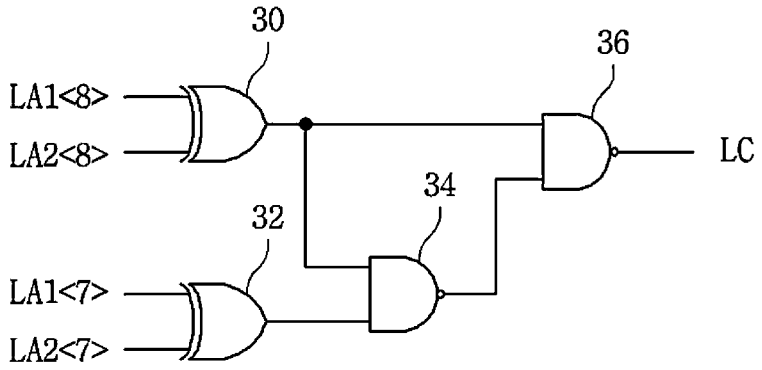
FIG. 3 is a circuit diagram illustrating a current controller of FIG. 2.

Referring to FIG. 3, the current controller 28 may be configured to include a first calculation circuit 30, a second calculation circuit 32, a third calculation circuit 34 and a fourth calculation circuit 36.

The first calculation circuit 30 is configured to output a first calculated value by performing an exclusive OR operation on a most significant bit LA1<8> of the first display data LD1 and a most significant bit LA2<8> of the second display data LD2, and the second calculation circuit 32 is configured to output a second calculated value by performing an exclusive OR operation on a second most significant bit LA1<7> of the first display data LD1 and a second most significant bit LA2<7> of the second display data LD2.

The first calculation circuit 30 and the second calculation circuit 32 may be configured by exclusive OR gates. By the exclusive OR operation, the first calculation circuit 30 may output a calculated value of "0" when values of the most significant bit LA1<8> of the first display data LD1 and the most significant bit LA2<8> of the second display data LD2 are the same, and may output a calculated value of "1" when values of the most significant bit LA1<8> of the first display data LD1 and the most significant bit LA2<8> of the second display data LD2 are different. In addition, by the exclusive OR operation, the second calculation circuit 32 may output a calculated value of "0" when values of the second most significant bit LA1<7> of the first display data LD1 and the second most significant bit LA2<7> of the second display data LD2 are the same, and may output a calculated value of "1" when values of the second most significant bit LA1<7> of the first display data LD1 and the second most significant bit LA2<7> of the second display data LD2 are different.

The third calculation circuit 34 is configured to output a third calculated value by performing a NAND operation on the first calculated value of the first calculation circuit 30 and the second calculated value of the second calculation circuit 32.

The third calculation circuit 34 may be configured by a NAND gate. The third calculation circuit 34 may output a calculated value of "0" when both the first calculated value and the second calculated value are "1," and may output a calculated value of "1" when the first calculated value and the second calculated value are different or both the first calculated value and the second calculated value are "0."

The fourth calculation circuit 36 is configured to output a fourth calculated value by performing a NAND operation on the first calculated value of the first calculation circuit 30 and the third calculated value of the third calculation circuit 34.

The fourth calculation circuit 36 may be configured by a NAND gate. The fourth calculation circuit 36 may output a calculated value of "0" when both the first calculated value and the third calculated value are "1," and may output a calculated value of "1" when the first calculated value and the third calculated value are different or both the first calculated value and the third calculated value are "0."

The current controller 28 may output the fourth calculated value of the fourth calculation circuit 36 as the current control signal LC.

By the configuration of FIG. 3, the current controller 28 may classify a data change amount between the first display data LD1 and the second display data LD2 into a first change pattern equal to or larger than a preset reference and a second change pattern smaller than the preset reference, and may provide a value corresponding to one of the first change pattern and the second change pattern as the current control signal LC.

In the case of the first change pattern, the fourth calculated value of the fourth calculation circuit 36 may be output as "1," and in response to this, the current control signal LC may be outputted as a high level. In the case of the second change pattern, the fourth calculated value of the fourth calculation circuit 36 may be output as "0," and in response to this, the current control signal LC may be outputted as a low level.

Figure 4:
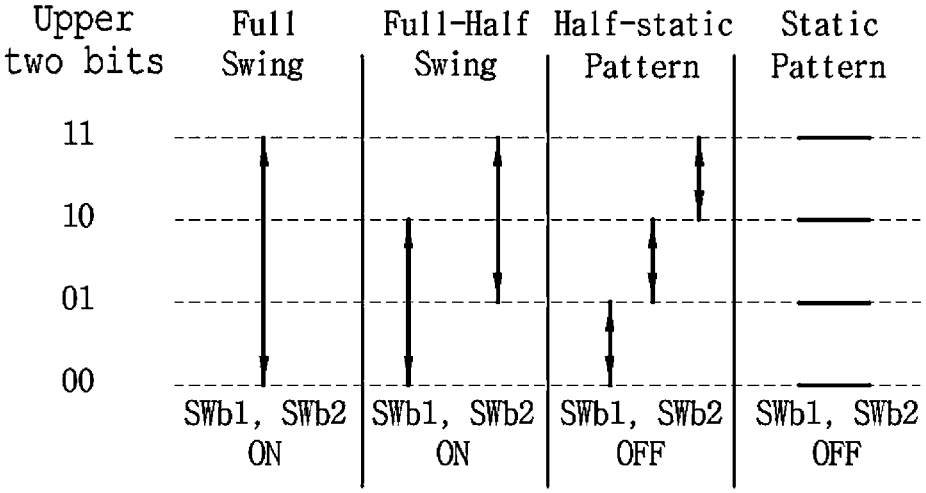
FIG. 4 is a diagram for explaining an example of bias current control according to change patterns.

Referring to FIG. 4, a data change amount may be classified into a full swing, a full-half swing, a half-static pattern and a static pattern.

The full swing may be defined as a case where a difference between values of the first upper bits LA1 of the first display data LD1 and the second upper bits LA2 of the second display data LD2, that is, a data change amount, corresponds to a binary number $(11)_2$. That is to say, the full swing corresponds to a case where ones of the first upper bits LA1 of the first display data LD1 and the second upper bits LA2 of the second display data LD2 have a value of "00" and the others have a value of "11."

The full-half swing may be defined as a case where a difference between values of the first upper bits LA1 of the first display data LD1 and the second upper bits LA2 of the second display data LD2 corresponds to a binary number $(10)_2$. For example, the full-half swing corresponds to a case where ones of the first upper bits LA1 of the first display data LD1 and the second upper bits LA2 of the second display data LD2 have a value of "11" and the others have a value of "01" or a case where ones of the first upper bits LA1 of the first display data LD1 and the second upper bits LA2 of the second display data LD2 have a value of "10" and the others have a value of "00."

The half-static pattern may be defined as a case where a difference between values of the first upper bits LA1 of the first display data LD1 and the second upper bits LA2 of the second display data LD2 corresponds to a binary number $(01)_2$. For example, the half-static pattern corresponds to a case where ones of the first upper bits LA1 of the first display data LD1 and the second upper bits LA2 of the second display data LD2 have a value of "11" and the others have a value of "10," a case where ones of the first upper bits LA1 of the first display data LD1 and the second upper bits LA2 of the second display data LD2 have a value of "10" and the others have a value of "01" or a case where ones of the first upper bits LA1 of the first display data LD1 and the second upper bits LA2 of the second display data LD2 have a value of "01" and the others have a value of "00."

The static pattern may be defined as a case where a difference between values of the first upper bits LA1 of the first display data LD1 and the second upper bits LA2 of the second display data LD2 corresponds to a binary number $(00)_2$. That is to say, the static pattern corresponds to a case where the first upper bits LA1 of the first display data LD1 and the second upper bits LA2 of the second display data LD2 are the same.

The full swing and the full-half swing correspond to a case where a change in the source signal SOUT by the first display data LD1 and the second display data LD2 is large, and corresponds to the first change pattern equal to or larger than the preset reference.

The half-static pattern and the static pattern correspond to a case where a change in the source signal SOUT by the first display data LD1 and the second display data LD2 is small, and corresponds to the second change pattern smaller than the preset reference.

The reference for identifying the first change pattern and the second change pattern may be set as that a difference between values of the first upper bits LA1 of the first display data LD1 and the second upper bits LA2 of the second display data LD2 is a binary number $(10)_2$.

In response to the full swing and full-half swing corresponding to the first change pattern, switches SWb1 and SWb2 of FIG. 6 to be described later are turned on. In response to the half-static pattern and the static pattern corresponding to the second change pattern, the switches SWb1 and SWb2 of FIG. 6 to be described later are turned off. This will be described later with reference to FIG. 6.

Figures 5, 6:
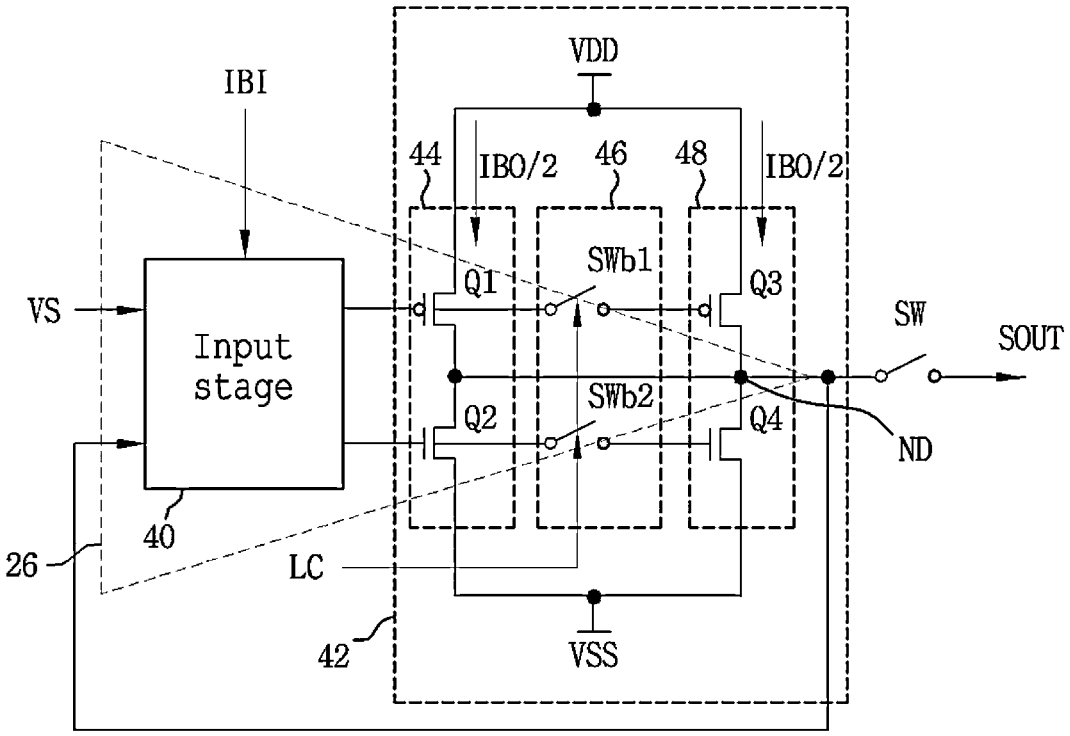
FIG. 5 is a diagram for explaining a current control signal according to the change patterns of FIG. 4.
FIG. 6 is a circuit diagram illustrating an example of an output buffer of FIG. 2.

FIG. 5 shows the fourth calculated value of the fourth calculation circuit 36 corresponding to a result of calculating the first upper bits LA1 of the first display data LD1 and the second upper bits LA2 of the second display data LD2, that is, the current control signal LC.

Referring to FIG. 5, when a difference between the first upper bits LA1 of the first display data LD1 and the second upper bits LA2 of the second display data LD2 corresponds to the first change pattern, the current control signal LC is outputted as "H," that is, a high level. When a difference between the first upper bits LA1 of the first display data LD1 and the second upper bits LA2 of the second display data LD2 corresponds to the second change pattern, the current control signal LC is outputted as "L," that is, a low level.

The output buffer 26 may output the source signal SOUT by being configured as shown in FIG. 6, and, in response to the current control signal LC provided by the current controller 28 of FIG. 3, may control the amount of a bias current to conform to a data change amount between the first display data LD1 and the second display data LD2.

Referring to FIG. 6, the output buffer 26 may be illustrated as including an input stage 40 and an output circuit 42. In FIG. 6, a switch SW is a switch for switching the output of the source signal SOUT of the output buffer 26 to the display panel 12.

In most cases, the output buffer 26 may be configured to receive the input voltage VS which is provided from the digital-to-analog converter 24 and the source signal SOUT which is fed back.

The input stage 40 is configured to receive the input voltage VS and the fed-back source signal SOUT, generate an internal voltage corresponding to a difference between the input voltage VS and the fed-back source signal SOUT, and provide the internal voltage to the output circuit 42.

By the above configuration, it may be understood that the input stage 40 outputs an internal voltage corresponding to the input voltage VS of a level corresponding to the data outputted from the second latch 22. The input stage 40 may be configured to receive the input voltage VS or convert the input voltage VS into an internal voltage, by using the bias current IBI. The bias current IBI may include a plurality of bias currents having different amounts of current depending on a design of the input stage 40.

The output circuit 42 may include an output sub-circuit 44, a switching circuit 46 and an output sub-circuit 48.

The output sub-circuit 44 may be configured to output a bias current IBO/2 of a preset amount of current to an output node ND by the internal voltage of the input stage 40 corresponding to the input voltage VS of a level corresponding to the data outputted from the second latch 22.

To this end, the output sub-circuit 44 is configured to include a PMOS transistor Q1 and an NMOS transistor Q2 which are connected in series. The internal voltage of the input stage 40 may be applied to gates of the PMOS transistor Q1 and the NMOS transistor Q2. The PMOS transistor Q1 and the NMOS transistor Q2 are connected to the output node ND through a common drain, a constant voltage VDD is applied to a source of the PMOS transistor Q1, and a ground voltage VSS is applied to a source of the NMOS transistor Q2.

The input stage 40 is configured to provide an internal voltage including a first voltage and a second voltage which have opposite levels, the first voltage is applied to the gate of the PMOS transistor Q1, and the second voltage is applied to the gate of the NMOS transistor Q2. Therefore, it may be understood that, when the first voltage of a low level is applied to the gate of the PMOS transistor Q1 and the second voltage of a high level is applied to the gate of the NMOS transistor Q2, the output sub-circuit 44 outputs the bias current IBO/2 to the output node ND in response to the internal voltage of the input stage 40.

The output sub-circuit 48 may be configured to output, when the internal voltage of the input stage 40 is provided through the switching circuit 46, the bias current IBO/2 of an amount of current set in advance by the internal voltage, to the output node ND.

To this end, the output sub-circuit 48 is configured to include a PMOS transistor Q3 and an NMOS transistor Q4 which are connected in series. The internal voltage of the input stage 40 transferred through the switching circuit 46 may be applied to gates of the PMOS transistor Q3 and the NMOS transistor Q4. The PMOS transistor Q3 and the NMOS transistor Q4 are connected to the output node ND through a common drain, the constant voltage VDD is applied to a source of the PMOS transistor Q3, and the ground voltage VSS is applied to a source of the NMOS transistor Q4.

Of the internal voltage of the input stage 40, the first voltage is applied to the gate of the PMOS transistor Q3, and the second voltage is applied to the gate of the NMOS transistor Q4. Therefore, it may be understood that, when the first voltage of a low level is applied to the gate of the PMOS transistor Q3 and the second voltage of a high level is applied to the gate of the NMOS transistor Q4, the output sub-circuit 48 outputs the bias current IBO/2 to the output node ND in response to the internal voltage of the input stage 40 transferred through the switching circuit 46.

In the embodiment of the present disclosure, the PMOS transistors Q1 and Q3 and the NMOS transistors Q2 and Q4 of the output sub-circuits 44 and 48 correspond to output transistors of the output buffer 26.

In the embodiment of the present disclosure, the output sub-circuit 44 and the output sub-circuit 48 may be configured to be able to drive the bias current IBO/2 of the same amount of current. A bias current having a maximum amount of current of the output circuit 42 may be represented as IBO, and the bias current of each of the output sub-circuit 44 and the output sub-circuit 48 may be represented as IBO/2. It may be understood that the bias current IBO/2 is to represent an amount of current corresponding to ½ of the maximum amount of current.

The switching circuit 46 may be configured to switch providing of the internal voltage to the output sub-circuit 48 by the current control signal LC.

To this end, the switching circuit 46 is configured to include switches SWb1 and SWb2 which switch the transfer of a pair of internal voltages, that is, the first voltage and the second voltage of the input stage 40, to the gates of the PMOS transistor Q3 and the NMOS transistor Q4 of the output sub-circuit 48 by the current control signal LC. The current control signal LC is applied in common to the switches SWb1 and SWb2. The switch SWb1 switches the transfer of the first voltage of the internal voltage of the input stage 40 to the gate of the PMOS transistor Q3, and the switch SWb2 switches the transfer of the second voltage of the internal voltage of the input stage 40 to the gate of the NMOS transistor Q4.

By the above configuration, when the current control signal LC of a high level is provided to the switching circuit 46 in correspondence to the first change pattern, the switches SWb1 and SWb2 may be turned on by the current control signal LC, and may provide the internal voltage of the input stage 40 to the gates of the PMOS transistor Q3 and the NMOS transistor Q4 of the output sub-circuit 48. Unlike this, when the current control signal LC of a low level is provided to the switching circuit 46 in correspondence to the second change pattern, the switches SWb1 and SWb2 may be turned off by the current control signal LC, and may not provide the internal voltage of the input stage 40 to the gates of the PMOS transistor Q3 and the NMOS transistor Q4 of the output sub-circuit 48. When the switches SWb1 and SWb2 are turned on, it may be understood that the switching circuit 46 is turned on, and when the switches SWb1 and SWb2 are turned off, it may be understood that the switching circuit 46 is turned off.

In other words, when the switching circuit 46 is turned on, the internal voltage may be provided to both the output sub-circuit 44 and the output sub-circuit 48, and both the output sub-circuit 44 and the output sub-circuit 48 may be normally driven. Therefore, the source signal SOUT may be outputted through the output node ND by the bias current IBO obtained by summing the bias current IBO/2 of the output sub-circuit 44 and the bias current IBO/2 of the output sub-circuit 48.

When the switching circuit 46 is turned off, the internal voltage of the input stage 40 is not transferred to the output sub-circuit 48. In this case, the output sub-circuit 44 may be normally driven, but the output sub-circuit 48 is not operated. Thus, the source signal SOUT may be outputted through the output node ND by the bias current IBO/2 of the output sub-circuit 44.

Namely, when a data change amount of display data DAT is small, the output buffer 26 may output the source signal SOUT by the bias current IBO/2 as only the output sub-circuit 44 is driven by the current control signal LC which is generated by determining the data change amount. That is to say, an amount of current consumption may be reduced by the bias current IBO/2 which is required to drive the output sub-circuit 48.

When a data change amount of display data DAT is large, the output buffer 26 may output the source signal SOUT by the bias current IBO as the output sub-circuit 44 and the output sub-circuit 48 are driven by the current control signal LC which is generated by determining the data change amount.

The output buffer 26 of the present disclosure may control an amount of current consumption by a bias current according to a data change amount of display data DAT by the embodiment of FIGS. 1 to 6, and as a result, the total amount of current consumption of the display driving circuit 10 may be reduced.

Figures 7, 8:
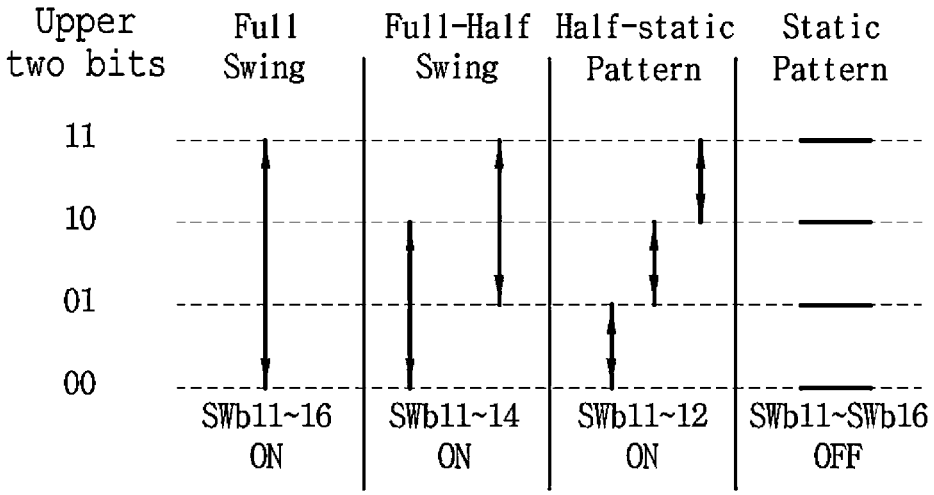
FIG. 7 is a diagram for explaining another example of bias current control according to change patterns.
FIG. 8 is a diagram for explaining a current control signal according to the change patterns of FIG. 7.

Meanwhile, in the present disclosure, as shown in FIG. 7, the current controller 28 may determine a data change mount more variously, and correspondingly, the output buffer 26 may be implemented to control a bias current in response to various change patterns.

To this end, the current controller 28 may be configured to classify a data change amount into a first change pattern equal to or larger than a preset first reference, a second change pattern smaller than the first reference and equal to or larger than a preset second reference, a third change pattern smaller than the second reference and equal to or larger than a preset third reference and a fourth change pattern smaller than the third reference, and to provide the current control signal LC which has a value corresponding to one of the first change pattern to the fourth change pattern. It may be understood that the current control signal LC includes current control signals LC1, LC2 and LC3 in order to represent a value corresponding to one of the first change pattern to the fourth change pattern.

A data change amount may be classified into a full swing, a full-half swing, a half-static pattern and a static pattern as described above with reference to FIG. 4. It may be understood that the first change pattern corresponds to the full swing, the second change pattern corresponds to the full-half swing, the third change pattern corresponds to the half-static pattern and the fourth change pattern corresponds to the static pattern.

In order to identify the first change pattern to the fourth change pattern, the first reference may be set as that a difference between values of the first upper bits LA1 of the first display data LD1 and the second upper bits LA2 of the second display data LD2 is a binary number $(11)_2$, the second reference may be set as that a difference between values of the first upper bits LA1 of the first display data LD1 and the second upper bits LA2 of the second display data LD2 is a binary number $(10)_2$, and the third reference may be set as that a difference between values of the first upper bits LA1 of the first display data LD1 and the second upper bits LA2 of the second display data LD2 is a binary number $(01)_2$.

In FIG. 7, switches SWb11 to SWb16 of FIG. 9 to be described later are turned on in response to the full swing, the switches SWb11 to SWb14 of FIG. 9 to be described later are turned on in response to the full-half swing, and the switches SWb11 and SWb12 of FIG. 9 to be described later are turned on in response to the half-static pattern. All of the switches SWb11 to SWb16 of FIG. 9 to be described later are turned off in response to the static pattern. This will be described later with reference to FIG. 9.

FIG. 8 shows the current control signals LC1, LC2 and LC3 corresponding to a result of calculating the first upper bits LA1 of the first display data LD1 and the second upper bits LA2 of the second display data LD2.

Referring to FIG. 8, the current control signals LC1, LC2 and LC3 may have levels, respectively, corresponding to results of calculating the first upper bits LA1 of the first display data LD1 and the second upper bits LA2 of the second display data LD2 to control the turn-on and turn-off of the switches SWb11 to SWb16 according to the full swing, the full-half swing, the half-static pattern and the static pattern.

Figure 9:
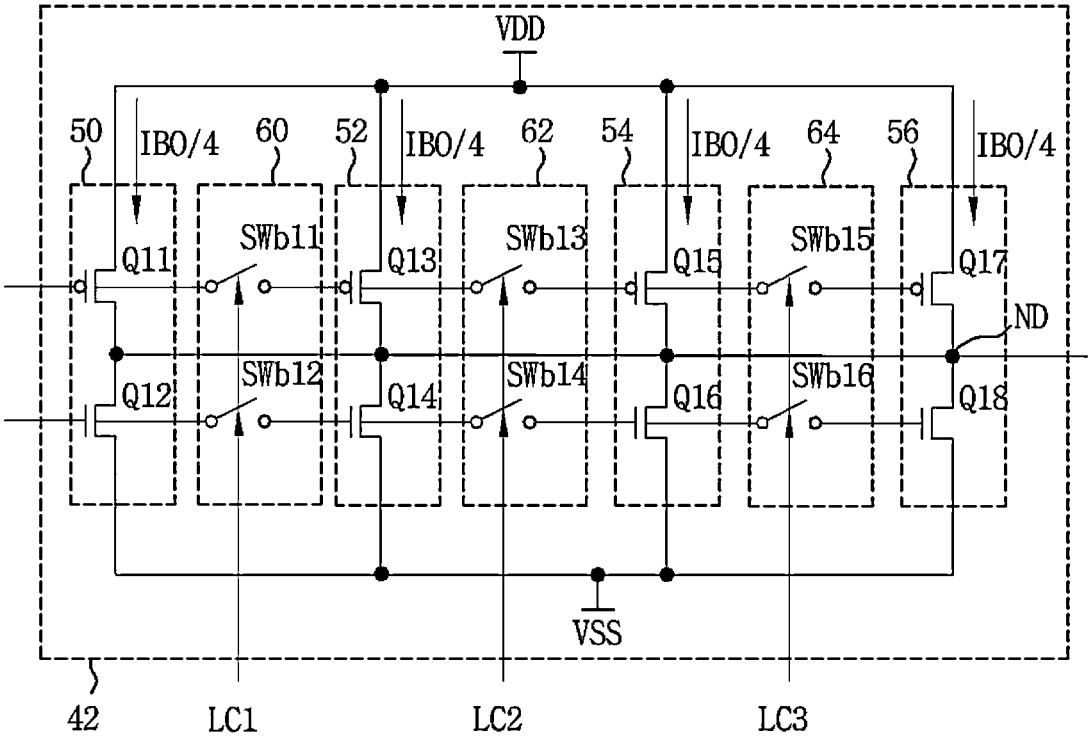
FIG. 9 is a circuit diagram illustrating another example of the output buffer of FIG. 2.

The output buffer 26 may output the source signal SOUT by being configured as shown in FIG. 9, and may control the amount of a bias current in response to the current control signals LC1, LC2 and LC3 provided as the results of FIG. 8.

The output buffer 26 is configured to output the source signal SOUT by a bias current of a first amount of current corresponding to the first change pattern, a second amount of current corresponding to the second change pattern, a third amount of current corresponding to the third change pattern or a fourth amount of current corresponding to the fourth change pattern, by the current control signals LC1, LC2 and LC3 corresponding to a change pattern.

The output buffer 26 may include an input stage 40 and an output circuit 42 as shown in FIG. 6. For the sake of convenience in explanation, FIG. 9 shows only the output circuit 42' of the output buffer 26 in detail.

The output circuit 42' of FIG. 9 may include output sub-circuits 50, 52, 54 and 56 and switching circuits 60, 62 and 64.

The output sub-circuit 50 is configured to output a bias current IBO/4 to an output node ND by the internal voltage of the input stage 40 corresponding to the input voltage VS of a level corresponding to the data outputted from the second latch 22. Each of the output sub-circuits 52, 54 and 56 is configured to output a bias current IBO/4 to the output node ND by the internal voltage of the input stage 40 when the internal voltage is provided.

By the above configuration, the output circuit 42' may output the source signal SOUT through the output node ND by the bias current IBO/4 of the output sub-circuit 50, a bias current IBO/2 by the output sub-circuits 50 and 52, a bias current 3IBO/4 by the output sub-circuits 50, 52 and 54 or a bias current IBO by the output circuits 50, 52, 54 and 56. The bias current IBO/2 means an amount of current obtained by summing the bias currents IBO/4 of the output sub-circuits 50 and 52, the bias current 3IBO/4 means an amount of current obtained by summing the bias currents IBO/4 of the output sub-circuits 50, 52 and 54, and the bias current IBO means an amount of current obtained by summing the bias currents IBO/4 of the output sub-circuits 50, 52, 54 and 56.

In the embodiment of FIG. 9, each of the output sub-circuits 50, 52, 54 and 56 may be configured to drive the bias current IBO/4 as the same amount of current. A bias current having a maximum amount of current of the output circuit 42' may be represented as IBO, and the bias current of each of the output sub-circuits 50, 52, 54 and 56 may be represented as IBO/4. It may be understood that the bias current IBO/4 is to represent an amount of current corresponding to ¼ of the bias current IBO.

In the same manner as the output sub-circuits 44 and 48 of FIG. 6, the output sub-circuits 50, 52, 54 and 56 are configured such that each of the output sub-circuits 50, 52, 54 and 56 includes a PMOS transistor and an NMOS transistor, the internal voltage is applied to gates of the PMOS transistor and the NMOS transistor, the PMOS transistor and the NMOS transistor are connected to the output node ND through a common drain, a constant voltage VDD is applied to a source of the PMOS transistor, and a ground voltage VSS is applied to a source of the NMOS transistor. The output sub-circuit 50 includes a PMOS transistor Q11 and an NMOS transistor Q12, the output sub-circuit 52 includes a PMOS transistor Q13 and an NMOS transistor Q14, the output sub-circuit 54 includes a PMOS transistor Q15 and an NMOS transistor Q16, and the output sub-circuit 56 includes a PMOS transistor Q17 and an NMOS transistor Q18. Since the configurations and operations of the output sub-circuits 50, 52, 54 and 56 may be understood by referring to the output sub-circuits 44 and 48 of FIG. 6, detailed description thereof will be omitted.

In the embodiment of FIG. 9, the PMOS transistors Q11, Q13, Q15 and Q17 and the NMOS transistors Q12, Q14, Q16 and Q18 of the output sub-circuits 50, 52, 54 and 56 correspond to output transistors of the output buffer 26.

The switching circuit 60 is configured to switch providing of the internal voltage of the input stage 40 to the output sub-circuit 52 by a first control signal of the current control signal LC, that is, the current control signal LC1, the switching circuit 62 is configured to switch providing of the internal voltage of the input stage 40 to the output sub-circuit 54 by a second control signal of the current control signal LC, that is, the current control signal LC2, and the switching circuit 64 is configured to switch providing of the internal voltage of the input stage 40 to the output sub-circuit 56 by a third control signal of the current control signal LC, that is, the current control signal LC3.

To this end, the switching circuit 60 is configured to include switches SWb11 and SWb12 which switch the transfer of a pair of internal voltages, that is, a first voltage and a second voltage, to the gates of the PMOS transistor Q13 and the NMOS transistor Q14 of the output sub-circuit 52 by the current control signal LC1. The switching circuit 62 is configured to include switches SWb13 and SWb14 which switch the transfer of a pair of internal voltages, that is, a first voltage and a second voltage, to the gates of the PMOS transistor Q15 and the NMOS transistor Q16 of the output sub-circuit 54 by the current control signal LC2. The switching circuit 64 is configured to include switches SWb15 and SWb16 which switch the transfer of a pair of internal voltages, that is, a first voltage and a second voltage, to the gates of the PMOS transistor Q17 and the NMOS transistor Q18 of the output sub-circuit 56 by the current control signal LC3.

Since the configurations and operations of the switching circuits 60, 62 and 64 of the embodiment of FIG. 9 may be understood by referring to the switching circuit 46 of FIG. 6, detailed description thereof will be omitted.

In the embodiment of FIG. 9, when the current control signals LC1, LC2 and LC3 of high levels are provided to the switching circuits 60, 62 and 64 in response to the full swing, that is, the first change pattern, the internal voltage of the input stage 40 may be provided to the output sub-circuits 52, 54 and 56 by the turn-on of the switching circuits 60, 62 and 64. In this case, the bias current IBO of the amount of current obtained by summing the bias currents IBO/4 of the output sub-circuits 50, 52, 54 and 56 may be provided to the output node ND, and the output buffer 26 may output the source signal SOUT corresponding to the amount of current of the bias current IBO.

When the current control signals LC1 and LC2 of high levels and the current control signal LC3 of a low level are provided to the switching circuits 60, 62 and 64 in response to the full-half swing, that is, the second change pattern, the internal voltage of the input stage 40 may be provided to the output sub-circuits 52 and 54 by the turn-on of the switching circuits 60 and 62. In this case, the bias current 3IBO/4 of the amount of current obtained by summing the bias currents IBO/4 of the output sub-circuits 50, 52 and 54 may be provided to the output node ND, and the output buffer 26 may output the source signal SOUT corresponding to the amount of current of the bias current 3IBO/4.

When the current control signal LC1 of a high level and the current control signals LC2 and LC3 of low levels are provided to the switching circuits 60, 62 and 64 in response to the half-static pattern, that is, the third change pattern, the internal voltage of the input stage 40 may be provided to the output sub-circuit 52 by the turn-on of the switching circuit 60. In this case, the bias current IBO/2 of the amount of current obtained by summing the bias currents IBO/4 of the output sub-circuits 50 and 52 may be provided to the output node ND, and the output buffer 26 may output the source signal SOUT corresponding to the amount of current of the bias current IBO/2.

When the current control signals LC1, LC2 and LC3 of low levels are provided to the switching circuits 60, 62 and 64 in response to the static pattern, that is, the fourth change pattern, the switching circuits 60, 62 and 64 are turned off. In this case, the bias current IBO/4 of the output sub-circuit 50 may be provided to the output node ND, and the output buffer 26 may output the source signal SOUT corresponding to the amount of current of the bias current IBO/4.

By the embodiment of FIG. 9, the output buffer 26 may output the source signal SOUT by a bias current according to selectively driving the output sub-circuits 52, 54 and 56 by the current control signal LC which is generated by determining a data change amount of display data DAT. Namely, it is possible to reduce an amount of current consumption by a bias current corresponding to an output sub-circuit which is selected not to be driven.

In addition, the output buffer 26 may control a bias current in various steps according to a data change amount of display data DAT, and may output the source signal SOUT according to a controlled bias current.

As is apparent from the above description, the present disclosure may control an amount of bias current required to output a source signal SOUT, depending on a data change amount of display data DAT in units of frames.

Therefore, a display driving circuit 10 of the present disclosure may control the amount of current consumption by a bias current, depending on a data change amount of display data DAT, and may reduce the total amount of current consumption of the display driving circuit 10.

In addition, the display driving circuit 10 of the present disclosure may be implemented to be able to control the amount of current consumption by a bias current, through simple addition of a switch and a logic gate.

What is claimed is:

1. A display driving circuit comprising:

a current controller configured to provide a current control signal corresponding to a data change amount between first display data of a current frame and second display data of a previous frame; and an output buffer configured to sequentially output source signals corresponding to the second display data and the first display data, wherein an amount of a bias current for driving an output transistor of the output buffer to output a source signal is controlled to depend on the data change amount in response to the current control signal, wherein the output buffer comprises:

a first output sub-circuit configured to output a first bias current of a first amount of current to an output node by an internal voltage corresponding to an input voltage;

a second output sub-circuit configured to output, when the internal voltage is provided, a second bias current of a second amount of current to the output node by the internal voltage; and a switching circuit configured to switch providing of the internal voltage to the second output sub-circuit by the current control signal, wherein the source signal is outputted through the output node by the first bias current or by the first bias current and the second bias current.

2. The display driving circuit according to claim 1, wherein the current controller compares first upper bits of a preset number of bits in the first display data and second upper bits of the preset number of bits in the second display data, and provides the current control signal as a comparison result.

3. The display driving circuit according to claim 2, wherein the current controller receives a most significant bit and a second most significant bit of the first display data as the first upper bits, and receives a most significant bit and a second most significant bit of the second display data as the second upper bits, and the current controller provides the current control signal corresponding to a difference between values of the first upper bits and the second upper bits.

4. The display driving circuit according to claim 1, wherein the current controller classifies the data change amount into a first change pattern equal to or larger than a preset reference and a second change pattern smaller than the preset reference, and provides the current control signal which has a value corresponding to one of the first change pattern and the second change pattern, and the output buffer receives the current control signal corresponding to the first change pattern or the second change pattern, and outputs the source signal by the bias current of a first amount of current corresponding to the first change pattern or a second amount of current corresponding to the second change pattern.

5. The display driving circuit according to claim 1, wherein the output buffer comprises:

a first output sub-circuit configured to output a first bias current of a first amount of current to an output node by an internal voltage corresponding to an input voltage;

a second output sub-circuit configured to output, when the internal voltage is provided, a second bias current of a second amount of current to the output node by the internal voltage;

a third output sub-circuit configured to output, when the internal voltage is provided, a third bias current of a third amount of current to the output node by the internal voltage;

a fourth output sub-circuit configured to output, when the internal voltage is provided, a fourth bias current of a fourth amount of current to the output node by the internal voltage;

a first switching circuit configured to switch providing of the internal voltage to the second output sub-circuit by a first control signal of the current control signal;

a second switching circuit configured to switch providing of the internal voltage to the third output sub-circuit by a second control signal of the current control signal; and a third switching circuit configured to switch providing of the internal voltage to the fourth output sub-circuit by a third control signal of the current control signal, wherein the source signal is outputted through the output node by the first bias current, by the first bias current and the second bias current, by the first bias current to the third bias current or by the first bias current to the fourth bias current.

6. The display driving circuit according to claim 1, wherein the current controller classifies the data change amount into a first change pattern equal to or larger than a preset first reference, a second change pattern smaller than the first reference and equal to or larger than a preset second reference, a third change pattern smaller than the second reference and equal to or larger than a preset third reference and a fourth change pattern smaller than the third reference, and provides the current control signal which has a value corresponding to one of the first change pattern to the fourth change pattern, and the output buffer receives the current control signal corresponding to one of the first change pattern to the fourth change pattern, and outputs the source signal by the bias current of a first amount of current corresponding to the first change pattern, a second amount of current corresponding to the second change pattern, a third amount of current corresponding to the third change pattern or a fourth amount of current corresponding to the fourth change pattern.

7. A display driving circuit comprising:

a first latch configured to store first display data of a current frame;

a second latch configured to store second display data of a previous frame transferred from the first latch;

a current controller configured to provide a current control signal corresponding to a data change amount between the first display data and the second display data; and an output buffer configured to sequentially output source signals corresponding to the second display data and the first display data outputted by the unit of frame from the second latch, wherein an amount of a bias current for driving an output transistor of the output buffer to out a source signal is controlled to depend on the data change amount in response to the current control signal, wherein the output buffer comprises:

a first output sub-circuit configured to output a first bias current of a first amount of current to an output node by an internal voltage corresponding to an input voltage of a level corresponding to data outputted from the second latch;

a second output sub-circuit configured to output, when the internal voltage is provided, a second bias current of a second amount of current to the output node by the internal voltage; and a switching circuit configured to switch providing of the internal voltage to the second output sub-circuit by the current control signal, wherein the source signal is outputted through the output node by the first bias current or by the first bias current and the second bias current.

8. The display driving circuit according to claim 7, wherein the current controller receives a most significant bit and a second most significant bit of the first display data as first upper bits, and receives a most significant bit and a second most significant bit of the second display data as second upper bits, and the current controller provides the current control signal corresponding to a difference between values of the first upper bits and the second upper bits.

9. The display driving circuit according to claim 8, wherein the current controller comprises:

a first calculation circuit configured to output a first calculated value by performing an exclusive OR operation on the most significant bit of the first display data and the most significant bit of the second display data;

a second calculation circuit configured to output a second calculated value by performing an exclusive OR operation on the second most significant bit of the first display data and the second most significant bit of the second display data;

a third calculation circuit configured to output a third calculated value by performing a NAND operation on the first calculated value and the second calculated value; and a fourth calculation circuit configured to output a fourth calculated value by performing a NAND operation on the first calculated value and the third calculated value, wherein the current controller outputs the current control signal corresponding to the fourth calculated value.

10. The display driving circuit according to claim 7, wherein each of the first output sub-circuit and the second output sub-circuit includes a PMOS transistor and an NMOS transistor which are operated by a pair of internal voltages and are connected in series, and the switching circuit includes a first switch and a second switch which switch transfer of the pair of internal voltage to gates of the PMOS transistor and the NMOS transistor of the second output sub-circuit by the current control signal.

11. The display driving circuit according to claim 7, wherein the current controller classifies the data change amount into a first change pattern equal to or larger than a preset reference and a second change pattern smaller than the reference, and the current controller provides the current control signal which has a value corresponding to one of the first change pattern and the second change pattern.

12. The display driving circuit according to claim 11, wherein the output buffer receives the current control signal corresponding to the first change pattern or the second change pattern, and outputs the source signal by the bias current of a first amount of current corresponding to the first change pattern or a second amount of current corresponding to the second change pattern.

13. The display driving circuit according to claim 7, wherein the output buffer comprises:

a first output sub-circuit configured to output a first bias current of a first amount of current to an output node by an internal voltage corresponding to an input voltage of a level corresponding to data outputted from the second latch;

a second output sub-circuit configured to output, when the internal voltage is provided, a second bias current of a second amount of current to the output node by the internal voltage;

a third output sub-circuit configured to output, when the internal voltage is provided, a third bias current of a third amount of current to the output node by the internal voltage;

a fourth output sub-circuit configured to output, when the internal voltage is provided, a fourth bias current of a fourth amount of current to the output node by the internal voltage;

a first switching circuit configured to switch providing of the internal voltage to the second output sub-circuit by a first control signal of the current control signal;

a second switching circuit configured to switch providing of the internal voltage to the third output sub-circuit by a second control signal of the current control signal; and a third switching circuit configured to switch providing of the internal voltage to the fourth output sub-circuit by a third control signal of the current control signal, wherein the source signal is outputted through the output node by the first bias current, by the first bias current and the second bias current, by the first bias current to the third bias current or by the first bias current to the fourth bias current.

14. The display driving circuit according to claim 13, wherein each of the first output sub-circuit to the fourth output sub-circuit includes a PMOS transistor and an NMOS transistor which are operated by a pair of internal voltages and are connected in series, and each of the first switching circuit to the third switch circuit includes a first switch and a second switch which switch transfer of the pair of internal voltage to gates of the PMOS transistor and the NMOS transistor of an output sub-circuit corresponding thereto by a control signal corresponding thereto.

15. The display driving circuit according to claim 7, wherein the current controller classifies the data change amount into a first change pattern equal to or larger than a first preset reference, a second change pattern smaller than the first reference and equal to or larger than a preset second reference, a third change pattern smaller than the second reference and equal to or larger than a preset third reference, and a fourth change pattern smaller than the third reference, and the current controller provides the current control signal which has a value corresponding to one of the first change pattern to the fourth change pattern.

16. The display driving circuit according to claim 15, wherein the output buffer receives the current control signal corresponding to one of the first change pattern to the fourth change pattern, and outputs the source signal by the bias current of a first amount of current corresponding to the first change pattern, a second amount of current corresponding to the second change pattern, a third amount of current corresponding to the third change pattern or a fourth amount of current corresponding to the fourth change pattern.

* * * * *